United States Patent [19]

Vernon et al.

[11] 4,338,182

[45] Jul. 6, 1982

[54] MULTIPLE-STAGE HYDROGEN-DONOR COAL LIQUEFACTION

[75] Inventors: Lonnie W. Vernon; Peter S. Maa, both of Baytown, Tex.

[73] Assignee: Exxon Research & Engineering Co., Florham Park, N.J.

[21] Appl. No.: 950,951

[22] Filed: Oct. 13, 1978

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,583,900 | 6/1971 | Gatsis | 208/8 LE |
| 3,607,719 | 9/1971 | Johnson et al. | 208/10 |
| 3,617,465 | 11/1971 | Wolk et al. | 208/8 |
| 3,679,573 | 7/1972 | Johnson | 208/10 |
| 3,692,662 | 9/1972 | Wilson et al. | 208/8 |
| 3,700,584 | 10/1972 | Johanson et al. | 208/10 |
| 3,791,957 | 2/1974 | Wolk | 208/10 |
| 4,083,769 | 4/1978 | Hildebrand et al. | 208/10 |

*Primary Examiner*—Delbert E. Gantz
*Assistant Examiner*—William G. Wright
*Attorney, Agent, or Firm*—Wayne Hoover

[57] ABSTRACT

An improved process for liquefying coal and similar solid carbonaceous materials wherein the liquefaction is accomplished in a plurality of zones or stages and wherein the temperature is increased either linearly or nonlinearly in the first zone or stage, aromatics which are produced, liberated or contained in the solvent are separated after the first zone or stage and the liquefaction is continued in at least one other stage, at a temperature at least as high as the final temperature in the first zone or stage. In a preferred embodiment, the temperature in the first stage will be increased at least 50° F. The improved process results in a higher conversion of carbon contained in the coal or similar solid carbonaceous material to liquid products.

15 Claims, 2 Drawing Figures

MULTIPLE-STAGE HYDROGEN-DONOR COAL LIQUEFACTION

BACKGROUND OF THE INVENTION

1. Field of the Invention

This invention relates to an improved process for converting coal or similar solid carbonaceous materials. More particularly, this invention relates to an improved process for liquefying coal and similar carbonaceous substances.

2. Description of the Prior Art

As is well known, coal has long been used as a fuel in many areas. For several reasons, such as handling problems, waste disposal problems, pollution problems and the like, coal has not been a particularly desirable fuel from the ultimate consumers point of view. As a result, oil and gas have enjoyed a dominant position, from the standpoint of fuel sources, throughout the world.

As is also well known, proven petroleum and gas reserves are shrinking throughout the world and the need for alternate sources of energy is becoming more and more apparent. One such alternate source is, of course, coal since coal is an abundant fossil fuel in many countries throughout the world. Before coal will be widely accepted as a fuel, however, it is believed necessary to convert the same to a form which will not suffer from the several disadvantages alluded to previously.

To this end, several processes wherein coal is either liquefied and/or gasified have been proposed heretofore. Of these, the processes wherein coal is liquefied appear to be more desirable since a broader range of products is produced and these products are more readily heretofore. Of these, the processes wherein coal is liquefied appear to be more desirable since a broader range of products is produced and these products are more readily transported and stored.

Of these several liquefaction processes which have been heretofore proposed, those processes wherein coal is liquefied in the presence of a solvent or diluent, particularly a hydrogen-donor solvent or diluent, and a hydrogen containing gas appear to offer the greater advantages. In these processes, liquefaction is accomplished at elevated temperatures and pressures and hydrocarbon gases are invariably produced as byproducts. Moreover, none of the prior art processes have resulted in complete conversion of the coal or similar solid carbonaceous materials. As a result, a normally solid residue containing ash and unconverted coal is also invariably obtained. The gaseous products and/or the residue can be further processed to provide process hydrogen or can be burned to produce process energy. The quantity of gaseous products and unconverted coal, however, generally exceeds the quantity required for an overall energy and hydrogen balance. Moreover, the cost of recovering hydrogen and/or the heating value of the unconverted coal remaining in the residue is generally excessive. The need, therefore, for a liquefaction process which will maximize coal conversion thereby minimizing unconverted coal in the residue, is believed to be readily apparent. Moreover, the need for such a liquefaction process resulting in reduced gas yields is also believed to be apparent.

SUMMARY OF THE INVENTION

It has now been discovered that the foregoing and other disadvantages of the prior art processes can be reduced with the method of the present invention and an improved liquefaction process provided thereby. It is, therefore, an object of this invention to provide an improved liquefaction process. It is still another object of this invention to provide such a liquefaction process wherein the unconverted coal remaining in the residue is reduced. It is still a further object of this invention to provide such an improved liquefaction process wherein the gas yields are reduced. It is yet another object of this invention to provide such an improved liquefaction process wherein the liquid yields are increased. The foregoing and other objects and advantages will become apparent from the description set forth hereinafter and from the drawings appended thereto.

In accordance with the present invention, the foregoing and other objects and advantages are accomplished by liquefying a coal or similar solid carbonaceous material in the presence of a suitable solvent or diluent and in the presence of either hydrogen free radicals or a hydrogen containing gas at elevated temperatures and pressures and in a plurality of liquefaction stages. As indicated hereinafter, it is important that liquefaction be accomplished at least at two different temperatures during the first stage, that at least a portion of the aromatics which are liberated or produced during the first stage liquefaction or which might be contained in the solvent or diluent used in the first stage be separated and that liquefaction be continued at an elevated temperature in at least one additional stage after the separation is accomplished. A suitable solvent or diluent will be employed in each of the plurality of stages and the solvent may be the same or different in each of the stages.

DETAILED DESCRIPTION OF THE INVENTION

Figure 1:
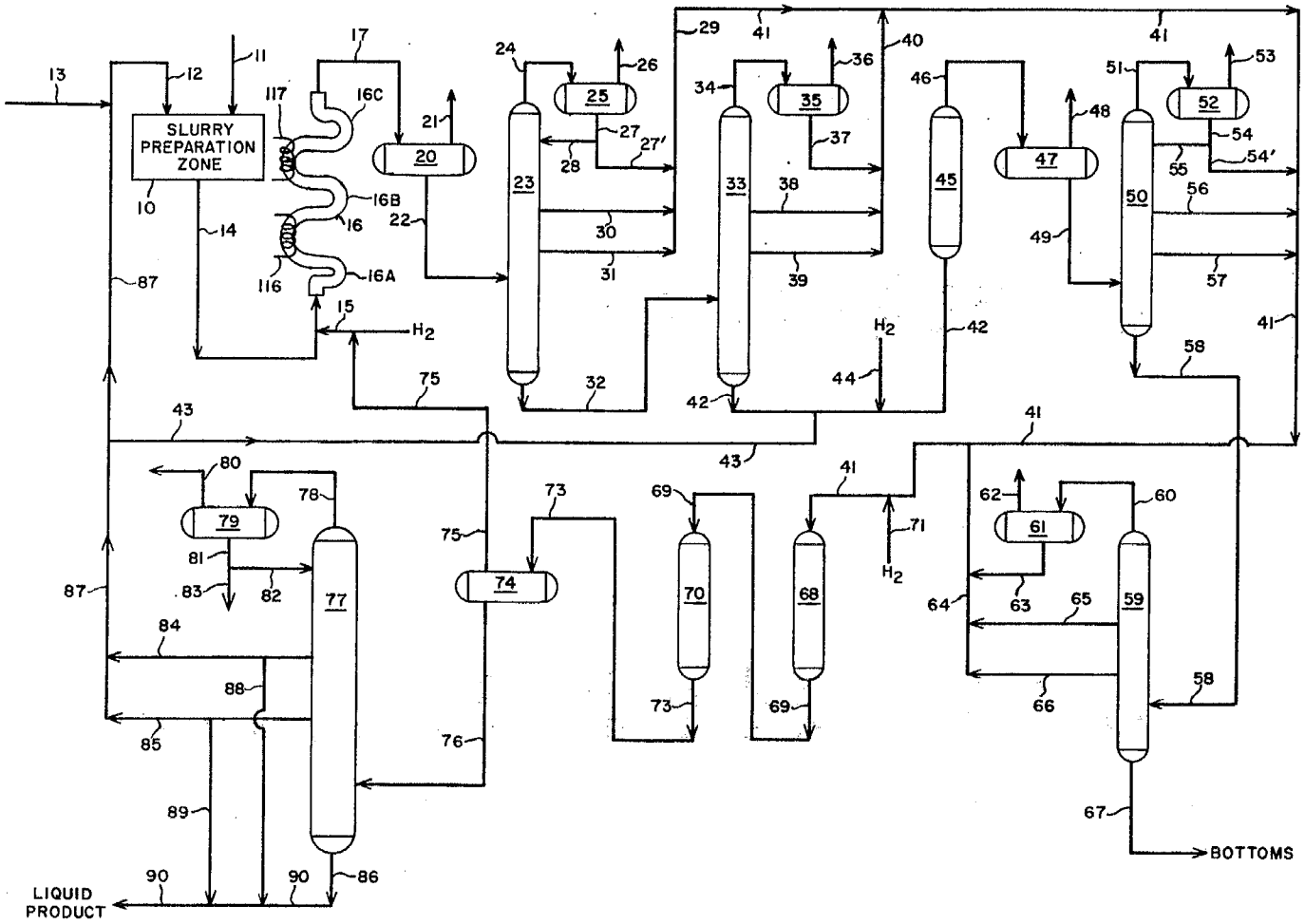
FIG. 1 is a schematic flow diagram of a process within the scope of the present invention.

As indicated, supra, the present invention relates to an improved process for liquefying coal and similar solid carbonaceous materials wherein the liquefaction is accomplished in a plurality of zones or stages and wherein the temperature is increased either linerally or nonlinerally in the first zone or stage, aromatics which are produced, liberated or contained in the solvent are separated after the first zone or stage and the liquefaction is continued in at least one other stage, at a temperature at least as high as the final temperature in the first zone or stage. As also indicated, supra, the solvent used in each of the several stages may be the same or different. After the liquefaction has been completed, the various products may be separated and used directly or subjected to further treatment in accordance with conventional technology.

In general, the method of the present invention can be used to liquefy any solid carbonaceous material which can, effectively, by hydrogenated. The method of this invention is particularly useful in the liquefaction of coal and may be used to liquefy any of the coals known in the prior art including anthracite, bituminous coal, subbituminous coal, lignite, peat, brown coal and the like.

In general, the solid carbonaceous material will be ground to a finely divided state. The particular particle size, or particle size range, actually employed, however, it not critical to the invention and, indeed, essentially any particle size can be employed. Notwithstanding this, however, generally, the solid carbonaceous material which is liquefied in accordance with this invention will be ground to a particle size of less than one-quarter inch, and preferably to a particle size of less than about 8 mesh (NBS sieve size).

After the solid carbonaceous material has been sized the same will then be slurried in a suitable solvent or diluent. Normally, the ratio of coal (in a mixture free basis) to solvent or diluent in the slurry will be within the range from about 1:3 to about 2:1, on a weight basis.

In general, any of the solvents or diluents known to be useful in the prior art can be used in the liquefaction method of the present invention. Such solvents or diluents include all types of hydrocarbons and particularly those having a boiling point within the range from about 400° F. to about 1000° F. The solvent or diluent may be a straight or branched-chain hydrocarbon, a cyclic hydrocarbon, a naphthenic or aromatic hydrocarbon, a phenol or substituted phenol, a hydroaromatic, a heterocyclic compound which may contain oxygen, nitrogen or sulfur, or mixtures of any one or more of these materials. Moreover, the solvent or diluent may be inert at the liquefaction conditions or the same may donate hydrogen at these conditions. Particularly effective solvents include hydrogenated creosote oil and solvents derived from the liquefaction of coal, particularly those boiling within the range from about 400° F. to about 900° F. Solvents derived from the liquefaction of coal are particularly effective when the same are at least partially hydrogenated to produce a solvent containing hydrogen-donor species. Such species are believed to be well known in the prior art and many are described in U.S. Pat. No. 3,867,275.

After the solid carbonaceous material has been slurried the slurry will then be subjected to liquefaction conditions in a plurality of liquefaction zones or stages. In the first zone or stage it is important that the temperature be increased from start to finish by at least 50° F. This first-stage liquefaction may be accomplished in a single vessel or in a plurality of vessels and the temperature increase may be accomplished either linearly or nonlinearly and, indeed, may be accomplished in steps. In any case, the first zone or stage liquefaction will, generally, be started at a temperature within the range from about 670° F. to about 750° F. and will be completed such that the final temperature is within the range from about 800° F. to about 900° F. Moreover, the first zone or stage liquefaction will be accomplished such that the slurry remains at a temperature below about 750° F. for at least 5 minutes and at a temperature above 800° F. for at least 10 minutes. Generally, the slurry will be maintained at a temperature within the range from about 670° F. to about 750° F. for a period of time within the range from about 5 to about 120 minutes and at a temperature within the range from about 800° F. to about 900° F. for a period of time within the range from about 10 to about 60 minutes. The total nominal holding time in the first stage will range from about 60 to about 160 minutes.

In general, any of the solvents or diluents previously indicated to be effective can be used in the first zone or stage liquefaction. Best results will, however, be obtained when the solvent or diluent used in the first zone or stage comprises from about 20 to about 50 weight percent of hydrogen-donor species. Such a solvent would, then, be capable of donating from about 0.5 to about 3 weight percent hydrogen, based on dry coal, to the solid carbonaceous material which is being liquefied.

While the inventors do not wish to be bound by any particular theory, it is believed that the liquefaction of coal and similar solid carbonaceous materials involves a host of competing reaction mechanisms including the hydrocracking of higher molecular weight species and the free radical polymerization of lower molecular weight species. It is also believed that certain of these reaction mechanisms proceed most favorably, at least, as the result of free radicals resulting from hydrogen-donor solvent species while certain other reaction mechanisms proceed most favorably, at least, as the result of free radicals derived from molecular hydrogen. Moreover, it is believed that the desirable liquefaction reactions occur most favorably at different temperatures. As a result, maximum coal conversion to liquids should occur when the liquefaction is accomplished, at least partially, over a broad temperature range and such that the temperature increases from start to finish.

While the inventors still do not wish to be bound by any particular theory, it is believed that as coal and similar solid carbonaceous materials are liquefied, especially in the presence of a hydrogen-donor solvent, unsaturated hydrocarbons are either produced or liberated. As the liquefaction proceeds, then, these unsaturated materials, such as aromatic materials, compete for available hydrogen or physically block the stabilization of free radicals generated during liquefaction, thereby effectively inhibiting the liquefaction reactions. As a result, maximum conversion of the solid carbonaceous material can be achieved only if these unsaturated materials are at least partially separated from the unconverted portion of the solid carbonaceous material as the liquefaction proceeds.

In light of the foregoing and consistent therewith, it has been found, in accordance with this invention, that significant increases in liquid product yields are realized when the liquefaction is accomplished in a plurality of stages and when from about 30 to about 60 weight percent of the solid carbonaceous material is liquefied (i.e., is converted 1000° F.− boiling materials) in a first stage wherein the temperature is higher at the outlet than at the inlet by at least 50° F. Ideally, the temperature increase will be continuous such that the rate of temperature increase is within the range from about 1° F. to about 16° F. per minute. Operating constraints will, however, hamper the use of a continuous temperature increase. As a result, stepped increases will normally be employed and as the number of steps is increased the temperature profile will closely approximate a continuous increase.

After the first zone or stage liquefaction has been completed and from about 30 to about 60 weight percent of the solid carbonaceous material (on a dry basis) has been converted, unsaturated liquid (and gases if present) compounds will be separated from the remaining, unconverted solid carbonaceous material. Such separation may be accomplished in any suitable manner including flashing, filtration, centrifugation, distillation, and the like. In general, sufficient separation will be realized when at least 50 weight percent of the total liquid boiling between about 400° F. and about 1000° F. is separated. Better results, however, will be achieved when from about 80 to about 100 weight percent of this liquid material is separated from the solid residue which includes unconverted solid carbonaceous material and unliquefiable mineral matter.

After the desired amount of liquid has been separated, the residue and any liquid remaining therewith will again be slurried with a suitable solvent and subjected to further liquefaction. In general, any of the solvents heretofore noted as suitable could be used although the use of a solvent containing aromatic materials should be avoided. This can, of course, be avoided to a sufficient extent by using a coal-derived solvent which has been hydrogenated such that at least 50 percent of the sites which would otherwise react with hydrogen at liquefaction conditions have been reacted with hydrogen prior to introduction into the second liquefaction zone or stage.

In general, the second liquefaction zone or stage will be operated at a temperature at least as high as the outlet temperature from the first liquefaction zone or stage. Generally, the second stage will be operated at a temperature within the range from about 800° F. to about 900° F. and the unconverted solid carbonaceous material will be held in this stage for a nominal holding time within the range from about 20 to about 100 minutes.

Generally, the first two liquefaction zones or stages will be operated such that from about 50 to about 80 weight percent of the solid carbonaceous material (on a moisture-free basis) is converted either to a liquid or a gaseous product. To the extent that still further conversion is desired, a second separation may be accomplished and the remaining unconverted solid carbonaceous material subjected to still further liquefaction in a third stage or all or a part of the unconverted material may be recycled to the second liquefaction zone or stage. When recycle is employed, the overall conversion will, generally, be increased by about 0 to about 20 percent. When a third stage is employed, from about 10 to about 65 weight percent of the remaining, unconverted carbonaceous material can be converted to 1000° F.− boiling material.

When at least 75 weight percent of the initial solid carbonaceous material has been converted to liquid and/or gaseous products, the liquids and gases may be separated from the solid residue and the residue either discarded or subjected to further treatment to recover one or more of the materials contained therein. When less than 75 percent of the solid carbonaceous material has been converted, however, it generally will be advantageous to either use the residue as a fuel or to convert the remaining unconverted solid carbonaceous material to coke in a suitable coking operation. Alternatively, the remaining, unconverted solid carbonaceous material can be subjected to gasification to produce a gaseous fuel or hydrogen.

In general, liquefaction in accordance with the method of this invention will be accomplished at an elevated pressure and a hydrogen containing gas will be present in all zones or stages. The pressure in each of the several stages may be the same or different but in any case will, generally, be within the range from about 500 to about 3000 psig. Moreover, molecular hydrogen will be present in an amount within the range from about 2 to about 6 weight percent based on moisture-free solid carbonaceous material.

DESCRIPTION OF THE PREFERRED EMBODIMENTS

In a preferred embodiment of the present invention, a coal/solvent slurry will be subjected to at least one step-temperature increase and most preferably to a plurality of such step-temperature increases during the first liquefaction zone or stage. Such an embodiment is illustrated in FIG. 1. Referring, then, to FIG. 1, a finely divided solid carbonaceous material is introduced into slurry preparation zone 10 through line 11 and is combined with a suitable solvent introduced into the slurry preparation zone through line 12. In the embodiment illustrated, the solvent employed may be a recycle solvent which is introduced through line 12 from line 87 while makeup solvent, when desired, or once-through solvent when desired, may be introduced into line 12 through line 13. In a preferred embodiment, the solid carbonaceous material will be combined with solvent at a solvent-to-coal weight ratio within the range from about 0.5:1 to about 3:1 (based on dry coal), most preferably from about 1.0:1 to about 2:1. In general, any suitable means such as agitation, turbulence or the like, may be used to effect the desired slurrying of the solid carbonaceous material and solvent mixture. Moreover, during preparation and in the slurry preparation zone or immediately thereafter, the slurry may be preheated to the desired temperature for introduction into the first liquefaction zone or stage. In the preferred embodiment, the slurry will be heated to a temperature within the range from about 450° F. to about 750° F., via means which are not shown, before introduction into the first-liquefaction zone or stage. Also, while not illustrated, moisture can and preferably will be withdrawn from the slurry preparation vessel or downstream thereof, if the coal has not previously been dried, such that the moisture content of the solid carbonaceous material actually fed to the first liquefaction zone or stage is within the range from about 0 to about 5 weight percent based on dry carbonaceous material.

After the slurry has been prepared and heated to the desired temperature and the solid carbonaceous material dried, as desired, the slurry is fed to the first-liquefaction zone or stage 16 through line 14. Prior to introduction into the liquefaction zone or stage the slurry is also combined with molecular hydrogen which is introduced through line 15. In the embodiment illustrated, the hydrogen actually employed is withdrawn from the solvent hydrogenation zone and generally will be combined with makeup hydrogen. It is not, however, critical to the present invention that the hydrogen from the solvent hydrogenation zone be used and, indeed, it is within the scope of this invention to use hydrogen from essentially any source.

In the first-liquefaction zone or stage, and as has been indicated previously, the combined slurry and molecular hydrogen will be subjected to at least one step-temperature increase. When a single step is used the initial liquefaction will be accomplished at a temperature within the range from about 670° F. to about 750° F. and the temperature will then be increased by an amount of at least 90° F. and generally by an amount within the range from about 800° F. to about 900° F. In the embodiment illustrated, the combined slurry and hydrogen are subjected to two step increases as the result of heat inputs from heaters 116 and 117. In this regard, it will be appreciated that while only two heaters or furnaces have been shown essentially any number of heaters or furnaces could be employed and as the number of heaters increases the temperature profile of the slurry as it passes through the first-liquefaction zone or stage will more closely approximate a linear increase. In any case, when a plurality of heaters is employed the heaters will, generally, be designed such that each will effect a temperature increase within the range from about 1° F. to about 100° F. and such that the total temperature increase within the first-liquefaction zone or stage is within the range from about 90° F. to about 230° F. In the embodiment illustrated, the first liquefaction zone or stage is, effectively, divided into three subzones or stages; viz., 16A, 16B and 16C. In the first subzone or stage, liquefaction will be accomplished essentially at the temperature at which the slurry was introduced into the liquefaction zone or stage. In the second subzone or stage the liquefaction will be accomplished at an increased temperature which is from about 45° F. to about 100° F. higher than the temperature employed in subzone 16A and in subzone 16C the liquefaction will again be accomplished at a temperature of from about 45 to about 100 degrees above the temperature used in subzone or stage 16B.

In the embodiment illustrated, the holding time in each of the subzones or stages 16A, 16B and 16C will be, as closely as possible, equal and each will range from about 22 to about 40 minutes such that the total holding time in the first liquefaction zone or stage is within the range from about 65 to about 120 minutes. In this regard, it should be noted that when more than two step temperature increases is employed the holding time at each temperature will, to the extent possible, be about equal to the holding time at all other temperatures although this is not critical to the present invention and some improvement in liquid yields will be realized if a holding time of at least about 5 minutes is used at any given temperature.

Figure 2:
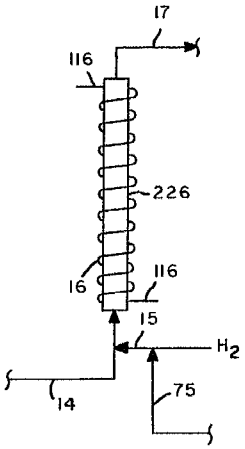
FIG. 2 is a schematic flow diagram of still another process within the scope of the present invention.

In a most preferred embodiment, which is illustrated in FIG. 2, the first liquefaction zone or stage 16 may be a single vessel 226 comprising heating elements such as resistant heaters which are positioned so as to provide, effectively, a linear heatup from inlet to outlet. Alternatively, the first liquefaction zone or stage could be, simply, an autoclave heated with a resistance heater and suitably programmed to provide a linear temperature increase during a batch-liquefaction operation. In either of these modes of operation, the liquid product from the first stage will, effectively, be processed in the same fashion and this subsequent processing, in a preferred embodiment, is further described by reference back to FIG. 1.

Referring, then, to FIG. 1 the effluent from the first liquefaction zone or stage 16 (or 226 in FIG. 2), which contains gaseous materials such as carbon monoxide, carbon dioxide, ammonia, hydrogen, hydrogen sulfide, methane, ethane, ethylene, and the like, light liquids, heavier liquids, unreacted solid carbonaceous material and certain unconvertable mineral matter is withdrawn through line 17 and then separated, as desired, before the unreacted coal is subjected to further liquefaction. In the embodiment illustrated, the effluent is first passed to a knockout drum 20 wherein gaseous components are flashed and withdrawn overhead through line 21 and the liquid and solids withdrawn through line 22. Also in the embodiment illustrated, the liquids and solids are then subjected to atmospheric distillation in distillation column 23. As is well known, such a column may be designed and operated to effect any desired separation. In the embodiment illustrated, however, components boiling below a temperature of about 400° F. are withdrawn through line 24, cooled, with means not illustrated, and then separated into a vapor phase and a liquid phase in knock-out drum 25. In the embodiment illustrated, vapors are withdrawn overhead through line 26. Normally, this vapor stream will contain light boiling point liquid and gas and may be employed as fuel gas for generation of process heat, steam reform to produce hydrogen or used for other purposes. The liquid phase is withdrawn through line 27. The liquids may be withdrawn at this point and used for any suitable purpose or they may, as illustrated, be partially recycled as reflux to the distillation column through line 28 and partially combined with other liquid products from the distillation column which are withdrawn through lines 30 and 31. In the embodiment illustrated, the liquid products are combined in line 29 and transferred to the hydrogenation section through line 41. Hydrogenation is not, however, essential to the present invention and the liquid products could be withdrawn from the process and used for essentially any purpose for which such liquefaction products are known to be useful. Moreover, while in the embodiment illustrated, all of the liquids are passed to the hydrogenation unit, it is within the scope of the invention to send only that fraction of the liquid products to be used as recycle solvent to the hydrogenation zone.

In the embodiment illustrated, the bottoms from the atmospheric distillation column are withdrawn through line 32. In general, sufficient unsaturated materials can be separated in an atmospheric distillation column and these bottoms could be passed directly to the second liquefaction zone 45. When this is done, the atmospheric distillation column will be operated such that from about 80 to about 96 weight percent of the total liquids boiling between about 400° F. and about 1000° F. is separated from the higher boiling liquid fraction, the unconverted coal and the mineral matter. When this is done, sufficient unsaturated material will, generally, be separated and the remaining unconverted portion of the solid carbonaceous material can be further liquefied with reduced interference as a result of competing reactions. For reasons believed to be readily apparent, sufficient separation of the lighter, unsaturated materials could be effected by using any of the conventional separation techniques such as filtration, centrifugation, settling and the like.

In a most preferred embodiment, the bottoms from the atmospheric distillation column 23 will be subjected to vacuum distillation in vacuum distillation column 33. When this is done, from about 80 to about 100 weight percent of the liquids boiling between about 400° F. to about 1000° F. can be separated from the unconverted solid carbonaceous material and the remaining unconverted material subjected to further liquefaction with essentially no competition from competing reactions resulting from the presence of unsaturated materials. In the embodiment illustrated, the vacuum distillation column will be operated in a manner similar to that employed in the operation of the atmospheric distillation column in that the lighter boiling materials are withdrawn overhead through line 34, cooled with means not illustrated, and then separated in knock-out drum 35 into a vapor fraction and a liquid fraction. In the embodiment illustrated, the vapor fraction is withdrawn through line 36 and may be used directly or subjected to further treatment in a manner described in copending application U.S. Pat. No. 716,036. The liquid fraction is withdrawn through line 37 and in the embodiment illustrated, is combined with other liquids withdrawn from the vacuum distillation column in line 40. The liquid could, however, be withdrawn from the operation at this point and used for any purpose for which liquids of this type are suitable. Also in the embodiment illustrated, two additional liquid fractions will be withdrawn through lines 38 and 39 and combined in line 40. In the embodiment illustrated, the combined liquids are then mixed with the liquids from the atmospheric distillation and passed to the hydrogenation unit. It is, however, within the scope of this invention to withdraw any part or all of the liquids from the vacuum distillation column and to use these liquids as either a fuel, a component thereof, or for any other suitable purpose.

In the embodiment illustrated, the bottoms from the vacuum distillation column are withdrawn through line 42. Generally, the bottoms will comprise from about 65 to about 85 weight percent of unconverted or partially converted solid carbonaceous material, from about 15 to about 25 weight percent mineral matter and from about 0 to about 30 weight percent of liquid products boiling below about 1000° F. but above about 700° F. In the embodiment illustrated, these bottoms are then combined with hydrogenated recycle solvent which is introduced through line 43 and molecular hydrogen which is introduced through line 44 and subjected to further liquefaction in the second liquefaction zone or stage 45. In this stage, the solvent will be combined with unconverted solid carbonaceous material in a ratio within the range from about 1:2 to about 3:1, based on solid, unconverted carbonaceous material. Also, hydrogen generally will be added in amount within the range from about 2 to about 6 weight percent based on solid carbonaceous material. As previously indicated, and not withstanding the preferred embodiment which is illustrated, it is within the scope of this invention to employ a different solvent in the second liquefaction zone or stage than was used in the first liquefaction zone or stage and to employ a solvent which does not contain any unsaturated components. The use of a hydrogenated recycle solvent, however, is most convenient and when this solvent contains from about 0.8 to about 2.5 weight percent donatable hydrogen, based on the weight of solvent, little interference as the result of competing hydrogenation reactions will be realized.

In general, the second liquefaction zone or stage will be operated at a temperature at least as high as the outlet temperature from the first liquefaction zone or stage and generally at a temperature within the range from about 800° to about 900° F. Moreover, the second liquefaction zone or stage will be operated such that the nominal holding time of the slurry in the zone or stage is within the range from about 25 to about 90 minutes and the second liquefaction zone or stage will be operated at an elevated pressure generally within the range from about 1000 to about 3000 psia, and preferably at a pressure within the range from about 1200 to about 2500 psia. The effluent from the second liquefaction zone or stage is withdrawn through line 46 and, to the extent that only two zones or stages are employed, will then be subjected to atmospheric and vacuum distillation so as to yield liquid products which are substantially solids free and a bottoms product comprising from about 50 to about 80 weight percent of solid unconverted carbonaceous material, from about 20 to about 50 weight percent mineral matter and from about 0 to about 20 weight percent of converted carbonaceous material boiling within the range from about 600° to about 1000° F. To the extent that a third liquefaction zone or stage is to be employed or to the extent that any unconverted solid carbonaceous material and the mineral matter is to be recycled to the second liquefaction zone, any of the methods previously described with respect to separation of the first-stage effluent may be employed. These include the use of atmospheric distillation alone, filtration, centrifugation, settling, and the like. In any case, combined atmospheric distillation and vacuum distillation, will, most preferably, be used to effect the final separation and this separation will be accomplished essentially in the manner illustrated in the figure.

Referring again to FIG. 1, then, and when a final separation or a most preferred separation is to be accomplished, the effluent in line 46 will be cooled, with means not illustrated, and then passed to knock-out drum 47 where a vapor phase will be withdrawn overhead through line 48 and a liquid phase which will contain any unconverted solid carbonaceous material and mineral matter is withdrawn through line 49. The vapor phase may be combined with the vapor phase withdrawn through line 26, or line 36 or both and the combined vapor stream may be used or further processed as previously indicated.

The liquid phase in line 49 will then be subjected to atmospheric distillation in atmospheric distillation column 50 to provide a low boiling stream withdrawn through line 51, a plurality of liquid streams withdrawn through lines 56 and 57 and a bottoms stream withdrawn through line 48. The overhead stream will then be cooled, with means not illustrated, and divided into a vapor stream in knock-out drum 52 with the vapor stream being withdrawn through line 53 and the liquid stream through line 54. Operation of this distillation column will, generally, be identical to the operation of atmospheric distillation column 23. The liquid in stream 54 may, then, be withdrawn or the same may be partially recycled to the distillation column through line 55 and the remainder combined with the other liquid products in line 41 through line 54'.

When, as illustrated, the multiple liquid streams are combined, the same will generally also be combined with liquids from the other distillation columns and subjected to hydrogenation.

The bottoms which are withdrawn through line 58 are then subjected to vacuum distillation and vacuum distillation column 59. In general, this column will be operated in essentially the same fashion as vacuum distillation column 33 to produce a low boiling stream which will be withdrawn through line 60, a plurality of liquid streams which will be withdrawn through lines 65 and 66 and a bottoms stream which is withdrawn through line 67. The vapor stream will, again, generally be divided in knock-out drum 61 into a vapor stream withdrawn through line 62 and a liquid stream withdrawn through line 63. The liquids withdrawn through the vacuum distillation column will, then, be combined in line 64 and further combined with the other column liquids in line 41 and subjected to hydrogenation.

The bottoms withdrawn through line 67 will, generally, comprise from about 50 to about 80 weight percent unconverted, solid carbonaceous material, from about 20 to about 50 weight percent mineral matter and from about 0 to about 20 weight percent of converted carbonaceous material boiling within the range from about 600° F. to about 1000° F. When this stream contains from about 40 to about 70 weight percent carbon, the same may be burned for fuel value or further processed to produce coke and/or hydrogen or other materials.

In the embodiment illustrated, the combined liquids from one or more of the distillation columns are fed to a hydrogenation unit through line 41. In general, any method may be employed to effect the desired hydrogenation and such methods are well known in the prior art. In general, the solvent hydrogenation reactor will, preferably, be operated at about the same pressure as that used in liquefaction reactor 45 and the same will, generally, be operated at a lower temperature than that used during the final stage liquefaction. In this regard, it should be noted that the temperature, pressure and space velocity as well as the amount of hydrogen actually introduced through line 71 will depend upon the particular feed combination subjected to hydrogenation, the catalyst employed and other variables. Optimization of such an operation is, however, well within the ordinary skill of the art and forms no part of the present invention. In any case, the hydrogenation zone will be operated such that from about 0.5 to about 2 weight percent hydrogen is taken up by the liquid products subjected to hydrogenation. In the embodiment illustrated, a two-stage hydrogenation zone is employed comprising a first stage 68 and a second stage 70. The zones are connected by line 69 and the hydrogenation effluent from the first stage will, generally, be quenched via means not illustrated, between the two stages. In any case, the effluent from the hydrogenation zone is withdrawn through line 73 and separated into a vapor phase and liquid phase in knock-out drum 74. The vapor phase which comprises hydrogen may be recycled to the first liquefaction zone or stage through line 75. When a relatively broad boiling range material has been subjected to hydrogenation, the liquid from the knock-out drum which is withdrawn through line 76 will be subjected to distillation to provide a cut boiling within the range from about 400° F. to about 850° F. and most preferably from about 400° F. to about 700° F. which will then be used as recycle solvent to both the first and second liquefaction zones. When only the fractions boiling within the solvent range from each of the distillation column is combined, however, it will be necessary to subject the hydrogenated liquid to distillation and, indeed, the liquid from the knock-out drum 74 could be recycled as required directly to the first and second liquefaction zones.

In the embodiment illustrated the hydrogenated effluent withdrawn through line 76 is preheated and passed to a final fractionator 77. Here the preheated feed is distilled to produce an overhead product composed primarily of gases and naphtha boiling range hydrocarbons. This stream is taken off overhead through line 78, cooled and introduced into distillation drum 79. The off-gases withdrawn through line 80 will be composed primarily of hydrogen and normally gaseous hydrocarbons but will include some normally liquid constituents in the naphtha boiling range. This stream may be used as a fuel or employed for other purposes. The liquid stream withdrawn from drum 79 through line 81, composed primarily of naphtha boiling range materials, in part recycled to the final fractionator as reflux through line 82 and in part recovered as product naphtha through line 83.

One or more sidestreams boiling above the naphtha boiling range are recovered from fractionator 77. In the particular embodiment illustrated, a first sidestream composed primarily of hydrocarbons boiling up to about 700° F. is taken off through line 84. A second sidestream composed primarily of hydrocarbons boiling below about 850° F. is withdrawn from the fractionator through line 85. A portion of each of these streams is recycled through lines 87, 11 and 43 for use as hydrogen-donor solvent in slurry preparation zone 10 and liquefaction reactor 45 respectively. A bottoms fraction composed primarily of hydrocarbons boiling below about 1000° F. is withdrawn from the fractionator through line 86 and passed into line 90. The liquids in lines 84 and 85 that are not recycled are passed respectively through lines 88 and 89 into line 90 where they are mixed with the bottoms stream from line 86 to form a liquid product.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example, 3.0 grams of a dry subbituminous coal containing 67.8 weight percent carbon and identified as a Wyodak coal was ground such that all particles were less than about 100 mesh (U.S. Standard). The ground coal was then slurried with 4.8 grams hydrogen-donor solvent obtained by liquefying a sample of the same Wyodak coal, separating a fraction of the liquid product having an initial boiling point of about 400° F. and a final boiling point of about 850° F. and then hydrogenating this fraction such that the solvent contained 10.0 weight percent hydrogen. The slurry was then placed in a tubing bomb reactor, heated initially to 700° F. and then subjected to a linear increase in temperature until a final temperature of 840° F. was reached after about 85 minutes. A hydrogen partial pressure of at least 1000 psia was maintained during the linear heatup. After this first stage liquefaction, the effluent was removed from the tubing bomb and the gas-make, liquid hydrocarbon production, water yield and the amount of solids residue remaining was determined. Also, the hydrogen consumed during this first-stage liquefaction was determined. The significant analytical results are summarized in Table 1 and as there indicated a liquid plus water yield of 43.7 percent was realized and 48.9 percent of the original feed material remained as a solid or at least as a 1000+° F. residue. As also indicated in Table 1, 51.1 percent of the coal feed was converted either to a gaseous or liquid product.

After the first-stage liquefaction, 100 percent of the material boiling below about 1000° F. were separated from the unconverted portion of the coal and other residual materials and the unconverted coal which remained combined with the mineral matter and other material having a boiling point above about 1000° F. were then combined with a donor solvent identical to that used in the first stage such that the solvent:coal ratio on a weight basis was 1.6:1. The resulting slurry was then heated to 840° F. and held at this temperature for 40 minutes. During the entire 40 minutes, a hydrogen partial pressure was maintained at at least 1000 psia.

Following the second-stage liquefaction, the effluent was again removed from the tubing bomb and the gas-make, liquid and water yields and the amount of solid residue remaining was determined. These results, too, are summarized in Table 1. As there indicated, the liquid plus water make in the second stage amounted to about 9.4 percent based on initial feed. Moreover, and as also indicated in Table 1, 61.2 percent of the feed coal was converted to either a gaseous or liquid product. As a result, only 38.8 percent of the coal remained in the residue from the second liquefaction stage.

EXAMPLE 2

In this example, and for purposes of comparison, the same coal used in Example 1 was ground to a particle size of less than about 100 mesh (U.S. Standard) and 3 grams were combined with 4.8 grams of a hydrogen-donor solvent identical to that used in both liquefaction stages in Example 1. The slurry was then heated in a tubing bomb reactor to a temperature of 840° F. and held for 50 minutes at a total pressure of 1800 psia and a hydrogen partial pressure of 1500 psia. After 50 minutes, the effluent was removed from the tubing bomb and the total gas-make, the total liquid plus water yield, and the amount of solid residue remaining was determined. The results obtained are summarized in Table 1 for purposes of convenient comparison and as will be apparent from the table the liquid plus water yield was only 37.5 percent compared to a liquid plus water yield of 53.1 percent in the two-stage operation.

EXAMPLE 3

In this example, the test described in Example 2 was repeated except that the holding time was extended to 120 minutes. After the 120 minutes, total gas-make, liquid and water yields and solid residue remaining was determined. Again, the results are summarized in Table 1 to facilitate convenient comparison. As will be apparent from Table 1, then, the liquid plus water yield dropped to 29.1 percent.

TABLE 1

| | Two-Stage | | | | |
|---|---|---|---|---|---|
| | 1st Stage | 2nd Stage | Total 2-Stage | Single Stage | Single Stage |
| Temperature, °F. | 700–840 | 840 | | 840 | 840 |
| Residence Time, Min. | 85 | 40 | | 50 | 120 |
| Yields, Wt. % Coal | | | | | |
| Gas Make | 8.3 | 1.6 | 9.9 | 10.5 | 22.0 |
| $CO_x$ | 6.0 | 0.2 | 6.2 | 5.6 | 6.9 |
| $C_1$–$C_3$ | 2.1 | 1.3 | 3.4 | 4.4 | 15.1 |
| Solid Residue | 48.9 | 38.8 | 38.8 | 53.1 | 51.7 |
| Liquid + Water | 43.7 | 9.4 | 53.1 | 37.5 | 29.1 |
| $H_2$ Consumption | 1.9 | 1.1 | 3.0 | 2.4 | 2.8 |

EXAMPLE 4

In this example, the test described in Example 1 was repeated except that a bituminous coal containing 68.7 weight percent available carbon was used. The coal was taken from an Illinois mine. The results obtained with this coal from each of the two liquefaction stages are are summarized in Table 2. As will be apparent, then, from Table 2 a total liquid plus water yield of 55.3 percent was obtained in both liquefaction stages while only 41.8 percent was obtained when a single staged temperature liquefaction was employed.

EXAMPLE 5

In this example, the test described in Example 2 was repeated using an Illinois coal identical to that used in Example 4 and a hydrogen-donor solvent identical to that used in Example 4. The results obtained in this example are summarized in Table 2.

EXAMPLE 6

In this example, the procedure described in Example 3 was repeated except that an Illinois coal identical to that used in Example 4 and a hydrogen-donor solvent derived from an Illinois coal and identical to that used in Example 4 was employed. The results obtained from this example are summarized in Table 2.

TABLE 2

| | Two-Stage | | | | |
|---|---|---|---|---|---|
| | 1st Stage | 2nd Stage | Total 2-Stage | Single Stage | Single Stage |
| Temperature, °F. | 700–800 | 840 | | 840 | 840 |
| Residence Time, Min | 85 | 40 | | 50 | 120 |
| Yields, Wt % Coal | | | | | |
| Gas-Make | 5.4 | 1.6 | 7.0 | 8.2 | 18.6 |
| $CO_x$ | 1.8 | 0.2 | 2.0 | 2.2 | 3.7 |
| $C_1$–$C_3$ | 2.8 | 1.4 | 4.2 | 5.2 | 14.5 |
| Solid Residue | 50.0 | 39.6 | 39.6 | 52.4 | 48.7 |
| Liquid + Water | 45.7 | 9.6 | 55.3 | 41.8 | 35.5 |
| $H_2$ Consumption | 2.0 | 1.1 | 3.1 | 2.4 | 2.8 |

From the foregoing examples, it is believed readily apparent that significant increases in liquefaction yields can be achieved by combining staged-temperature liquefaction; that is, liquefaction wherein the temperature is increased from start to finish during the liquefaction, and staged solvent liquefaction; that is, liquefaction wherein solid material is effectively separated between liquefaction stages and subjected to further liquefaction. The really surprising aspect of this discovery is, in effect, that the benefits associated with staged-temperature liquefaction and staged solvent liquefaction are additive and that when these two modes of operation are combined from about 50 to about 90 weight percent of the initially available carbon can be recovered either as a gaseous product or as a liquid product. Moreover, it is believed readily apparent from the foregoing examples that the increased carbon conversion is primarily due to conversion to liquid products since the gas product yield either remains the same or reduces as a result of the combination.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention what is claimed is:

1. A process for liquefying normally solid carbonaceous materials comprising the steps of:

(a) slurrying a particulate solid carbonaceous material with a suitable solvent such that the solvent/solid carbonaceous material weight ratio is within the range from about 0.5:1 to about 3:1;

(b) subjecting the resulting slurry to liquefaction in a first liquefaction stage wherein the temperature at the outlet of said stage is higher than the temperature at the inlet of said stage;

(c) separating at least 50 weight percent of the total liquid boiling within the range from about 400° to about 1000° F. from the effluent of the first liquefaction stage;

(d) slurrying at least a portion of the effluent remaining after the separation of step (c) with a suitable solvent such that the solvent/unconverted solid carbonaceous material weight ratio is within the range from about 0.5:1 to about 3:1;

(e) subjecting the resulting slurry of solvent and unconverted solid carbonaceous material to liquefaction conditions in a second liquefaction stage or zone; and (f) recovering a liquid product from the second liquefaction stage.

2. The process of claim 1 wherein the temperature during the first liquefaction stage is increased by an amount of at least 50° F.

3. The process of claim 2 wherein the temperature increase is accomplished as a "step increase".

4. The process of claim 2 where the temperature increase is accomplished with a plurality of step increases.

5. The process of claim 2 wherein the temperature increase is accomplished continuously at a rate within the range from about 1 to about 16° F. per minute.

6. The process of claim 5 where the temperature increase is linear with time.

7. The process of claim 1 wherein from about 80 to about 100 weight percent of the total liquids boiling within the range from about 400° F. to about 1000° F. are separated from the effluent from the first liquefaction zone and the remaining portion of the effluent is subjected to further liquefaction in the second liquefaction stage.

8. The method of claim 1 wherein the liquefaction in the second stage is accomplished at a temperature within the range from about 800° to about 900° F.

9. The method of claim 1 wherein the holding time in the first liquefaction stage is within the range from about 60 to about 150 minutes.

10. The method of claim 1 wherein the nominal holding time in the second liquefaction zone is within the range from about 20 to about 100 minutes.

11. The method of claim 1 wherein liquefaction in the second liquefaction zone is accomplished at a temperature at least equal to the outlet temperature from the first liquefaction range.

12. The method of claim 1 wherein the desired separation is accomplished by using atmospheric and vacuum distillation and wherein the bottoms from the vacuum distillation column are subjected to further liquefaction in the second liquefaction stage.

13. The method of claim 1 wherein the liquid product is obtained by using atmospheric and vacuum distillation and at least a portion of the bottoms from the vacuum distillation column are recycled to the second liquefaction stage.

14. The process of claim 1 wherein the solvent used in step (a) is a hydrogen-donor solvent.

15. The process of claim 1 wherein the inlet temperature to the first liquefaction stage is within the range from about 670° F. to about 750° F.

* * * * *